US010393062B2

(12) United States Patent
Han

(10) Patent No.: US 10,393,062 B2
(45) Date of Patent: Aug. 27, 2019

(54) HIGH PRESSURE PISTON CROWN

(71) Applicant: Samyoung Machinery Co., Ltd., Gongju (KR)

(72) Inventor: Geum Tai Han, Daejeon (KR)

(73) Assignee: Samyoung Machinery Co., Ltd., Gongju (KR)

( * ) Notice: Subject to any disclaimer, the term of this patent is extended or adjusted under 35 U.S.C. 154(b) by 386 days.

(21) Appl. No.: 15/356,880

(22) Filed: Nov. 21, 2016

(65) Prior Publication Data

US 2018/0094602 A1 Apr. 5, 2018

(30) Foreign Application Priority Data

Sep. 30, 2016 (KR) ..... 10-2016-0126353

(51) Int. Cl.
*F02F 3/22* (2006.01)
*F02F 3/00* (2006.01)

(52) U.S. Cl.
CPC ..... *F02F 3/0076* (2013.01); *F02F 3/0023* (2013.01); *F02F 3/22* (2013.01)

(58) Field of Classification Search
CPC ..... F02F 3/0076; F02F 3/0023; F02F 3/22
See application file for complete search history.

(56) References Cited

U.S. PATENT DOCUMENTS 1,852,105 A * 4/1932 Boyd ..... F02F 3/0076 92/141
1,868,420 A * 7/1932 Kraemer ..... F02F 3/0076 92/236
3,104,922 A * 9/1963 Baster ..... F02F 3/0076 123/193.6
3,240,193 A * 3/1966 Ephraim, Jr. ..... F02F 3/0076 123/41.35

FOREIGN PATENT DOCUMENTS

DE 3830033 A1 6/1989
EP 0019323 A1 11/1980
EP 0758715 A1 2/1997
(Continued)

OTHER PUBLICATIONS

Office Action from the Korean Intellectual Property Office, dated Oct. 31, 2016.

(Continued)

*Primary Examiner* — Jacob M Amick
(74) *Attorney, Agent, or Firm* — STIP Law Group, LLC

(57) ABSTRACT

Provided is a high pressure piston crown capable of withstanding a higher pressure than the existing piston crown by changing an internal structure of the piston crown reciprocating in a cylinder while being coupled with an upper portion of a piston skirt. The high pressure piston crown includes: a rib part 100 including a plurality of main ribs 110 that are radially disposed, have one side connected to a central portion C of the high pressure piston crown, and have a cross sectional area wider toward an outside of the high pressure piston crown; an oil gallery 200 formed by the rib part 100 and making cooling oil introduced from the piston skirt flow therein; and a lower plate 300 formed under the central portion C and connected to the rib part 100 to have an inside thereof connected to the oil gallery 200.

6 Claims, 9 Drawing Sheets

B-B'

(56) References Cited

FOREIGN PATENT DOCUMENTS

| | | | |
|---|---|---|---|
| EP | 2821626 | B1 | 3/2016 |
| FR | 2582351 | A1 | 11/1986 |
| JP | 200320398 | A | 11/2000 |
| JP | 2013-083220 | | 5/2013 |
| KR | 10-1383121 | | 4/2014 |

OTHER PUBLICATIONS

Extended European Search Report of EP16199507 from the European Patent Office, dated Jun. 7, 2017.

* cited by examiner

- Prior Art -

- Prior Art -

HIGH PRESSURE PISTON CROWN

CROSS-REFERENCE TO RELATED APPLICATIONS

This application claims priority under 35 U.S.C. § 119 to Korean Patent Application No. 10-2016-0126353, filed on Sep. 30, 2016, in the Korean Intellectual Property Office, the disclosure of which is incorporated herein by reference in its entirety.

TECHNICAL FIELD

The following disclosure relates to a high-pressure compression piston (hereinafter, referred to as high pressure piston) crown, and more particularly, to a high pressure piston crown capable of withstanding a higher pressure than the existing piston crown.

BACKGROUND

A piston used along with an engine reciprocates inside a cylinder and is applied with a large force of 200 bars or more (in the case of a cylinder diameter of 20 cm, applied with a compression explosion pressure of 62 tons or more) per cross sectional area by an explosion expansion force of combustion gas of 1700° C. or more instantly generated at the time of an expansion stroke of the engine to serve to transfer the force to a connecting rod.

FIG. 1 illustrates the existing structure of the piston and is a part of the drawings disclosed in Korean Patent No. 10-1383121 ("piston assembly", published on Apr. 9, 2014, hereinafter, referred to as Prior art 1). Briefly describing the structure of the piston with reference to FIG. 1, an upper portion of the piston is called a piston head, a piston crown, or the like, which is a part corresponding of reference numeral 10 of FIG. 1. A part coupled with a lower portion of the piston crown 10 that is a piston skirt is a part corresponding to reference numeral 20 of FIG. 1 and is coupled with the piston crown 10 to serve to stabilize a reciprocation of the piston.

Meanwhile, with the increase in a size of an apparatus using the engine and the improvement demand for engine efficiency, an output of the engine tends to be increased, such that the pressure transferred to the piston crown is getting more increased. Therefore, there is a need to develop the piston crown that may withstand the high pressure. FIG. 2 is a portion of the drawings of the prior art 1. As illustrated in FIG. 2 of the prior art 1, a plurality of ribs 30 are radially formed on an upper surface of the piston crown and are collected on a central portion of the piston crown and thus connected to each other, thereby reinforcing the strength of the piston crown. However, the structure of the piston described in the prior art 1, ribs 30 are radially disposed to reinforce the strength of the piston crown, disturbs a flow of cooling oil so that the cooling performance of a surface of a piston head is decreased. And the larger the radius of the piston like a medium and large-sized piston, the weaker the rib becomes. As a result, the existing structure of the piston has a structural limitation in increasing th number of ribs to withstand the high explosion pressure.

RELATED ART DOCUMENT

Patent Document

Korean Patent No. 10-1383121 ("piston assembly", published on Apr. 9, 2014)

SUMMARY

An embodiment of the present invention is directed to providing a high pressure piston crown capable of withstanding a higher pressure while achieving a sufficient cooling performance.

In one general aspect, a high pressure piston crown coupled with one side of a piston skirt includes: a rib part 100 including a plurality of main ribs 110 that are radially disposed, have one side connected to a central portion C of the high pressure piston crown, and have a cross sectional area wider toward an outside of the high pressure piston crown; an oil gallery 200 formed by the rib part 100 and making cooling oil introduced from the piston skirt flow therein; and a lower plate 300 formed under the central portion C and connected to the rib part 100 to have an inside thereof connected to the oil gallery 200.

The rib part 100 may further include: a plurality of sub ribs 120 that extend toward the central portion C, extend to be shorter than the main rib 110, and have a cross sectional area wider toward the outside of the high pressure piston crown.

The rib part 100 may further include: a support part 130 connecting between the adjacent main ribs 110 or the sub ribs 120 and extending downwardly to be connected to the lower plate 300; and a bolt hole 140 formed on the support part 130 and having a bolt inserted thereinto.

A high pressure piston crown includes: an upper plate 400; a cylindrical side wall 500 extending downwardly from the upper plate 400; a lower plate 300 disposed under the upper plate 400 and having a smaller diameter than that of the upper plate 400, and having a central hole 310 perforated at a center thereof; and a plurality of main ribs 100 radially disposed along the inner circumferential surface of the side wall 500, extending up to the lower plate 300 downwardly from the upper plate 400, and extending up to a central portion C of the upper plate from the inner circumferential surface of the side wall 500, wherein a width of the main rib 110 is narrow from the side wall 500 toward the central portion C, cooling oil from the piston skirt is introduced through a cooling oil inlet 600 that is formed between the side wall 500 and an outer circumferential surface of the lower plate 300, the cooling oil introduced through the cooling oil inlet 600 flows through a cooling oil channel 700 that is formed among the upper plate 400, the lower plate 300, and the adjacent main ribs 110, and the cooling oil flowing through the cooling oil channel 700 is discharged through the central hole 310 of the lower plate 300.

The high pressure piston crown may further include: a plurality of sub ribs 120 disposed between the adjacent main ribs 110, extending up to the lower plate 300 downwardly from the upper plate 400, and extending up to the central hole 310 of the lower plate 300 from an inner circumferential surface of the side wall 500. A width of the sub rib 120 may be narrow from the side wall 500 toward the central portion C.

The high pressure piston crown may further include: a support part 130 connecting between the adjacent main ribs 110 or the main ribs 110 adjacent to the sub rib 120. The support part 130 may extend up to the lower plate 300 downwardly from the upper plate 400 and be provided with a bolt hole 140 formed at a center of the support part 130 to be bolt-connected with the piston skirt.

A thickness of the lower plate 300 may be thicker toward the central portion and thus a height of the cooling oil channel 700 may be lowered toward the central portion C.

A height of the main rib 110 located at an upper portion of the central hole 310 of the lower plate 300 may be lowered toward the central portion C.

Other features and aspects will be apparent from the following detailed description, the drawings, and the claims.

DETAILED DESCRIPTION OF MAIN ELEMENTS

Figure 1:
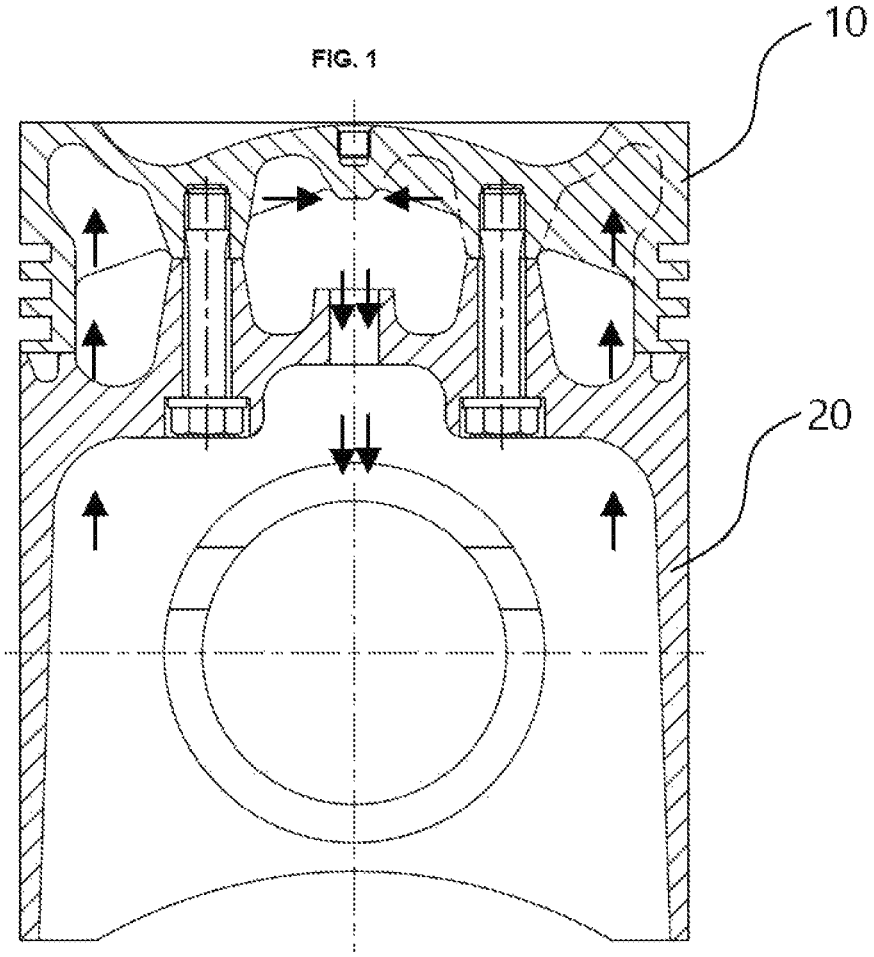
FIG. 1 is a cross-sectional view of the existing piston assembly.
Figure 2:
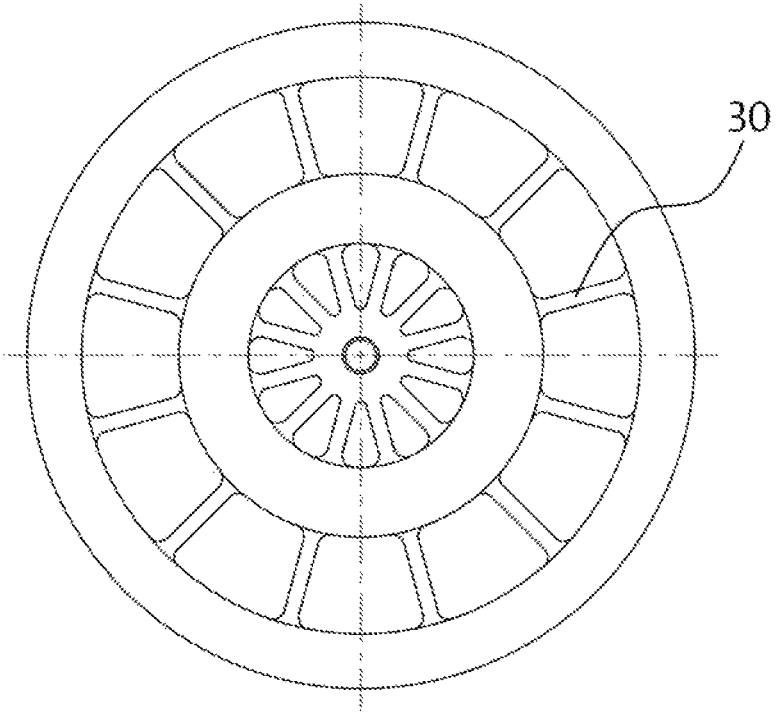
FIG. 2 is a plan view of the existing piston crown.

C: Central portion
100: Rib part
110: Main rib 110A: One side of main rib
120: Sub rib 120A: One side of sub rib
130: Support part
140: Bolt hole
200: Oil gallery
300: Lower plate
310: Central hole
400: Upper plate
500: Side wall
600: Cooling oil inlet
700: Cooling oil channel
W1: Width of one side of main rib
W2: Width of the other side of main rib

DETAILED DESCRIPTION OF EMBODIMENTS

Hereinafter, a high pressure piston crown according to an exemplary embodiment of the present invention will be described in detail with reference to the accompanying drawings.

Figure 3:
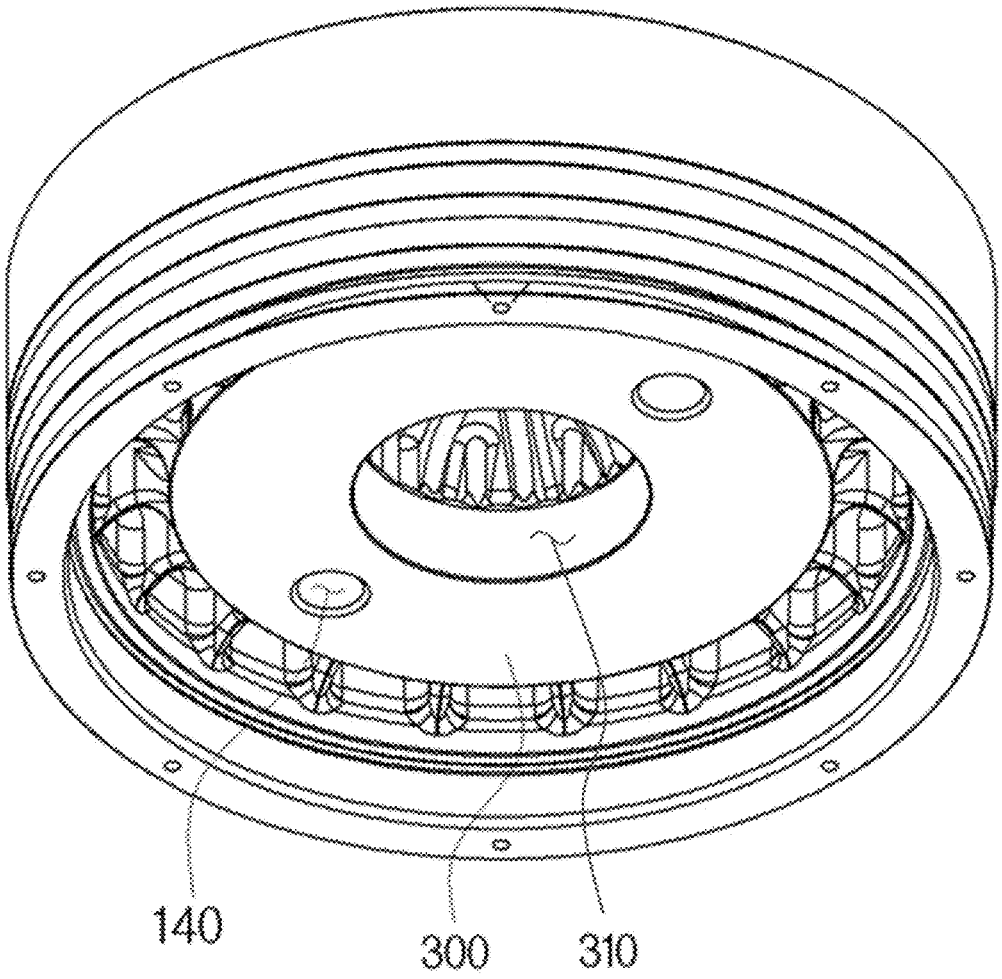
FIG. 3 is a perspective view of a piston crown according to an exemplary embodiment of the present invention.

FIG. 3 illustrates a state in which the high pressure piston crown according to the exemplary embodiment of the present invention overturns and thus a lower portion of the high pressure piston crown is exposed. In FIG. 3, an upper portion of the high pressure piston crown is coupled with one side of a piston skirt. That is, the lower portion of the piston crown illustrated in FIG. 1 becomes an upper portion illustrated in FIG. 3 and an explosion stroke of an engine is generated at the lower portion of the high pressure piston crown. The high pressure piston crown includes an upper plate 400 and a cylindrical side wall 500 extending downwardly from the upper plate 400. The upper portion of the high pressure piston crown that is in a direction in which an explosion is generated in an engine is closed by the upper plate 400 and therefore is directly applied with a pressure generated by the explosion and various components are formed in an upper side surface of FIG. 3 that is an opposite direction to the upper plate 400, and thus unique features of the present invention appear.

Figure 4:
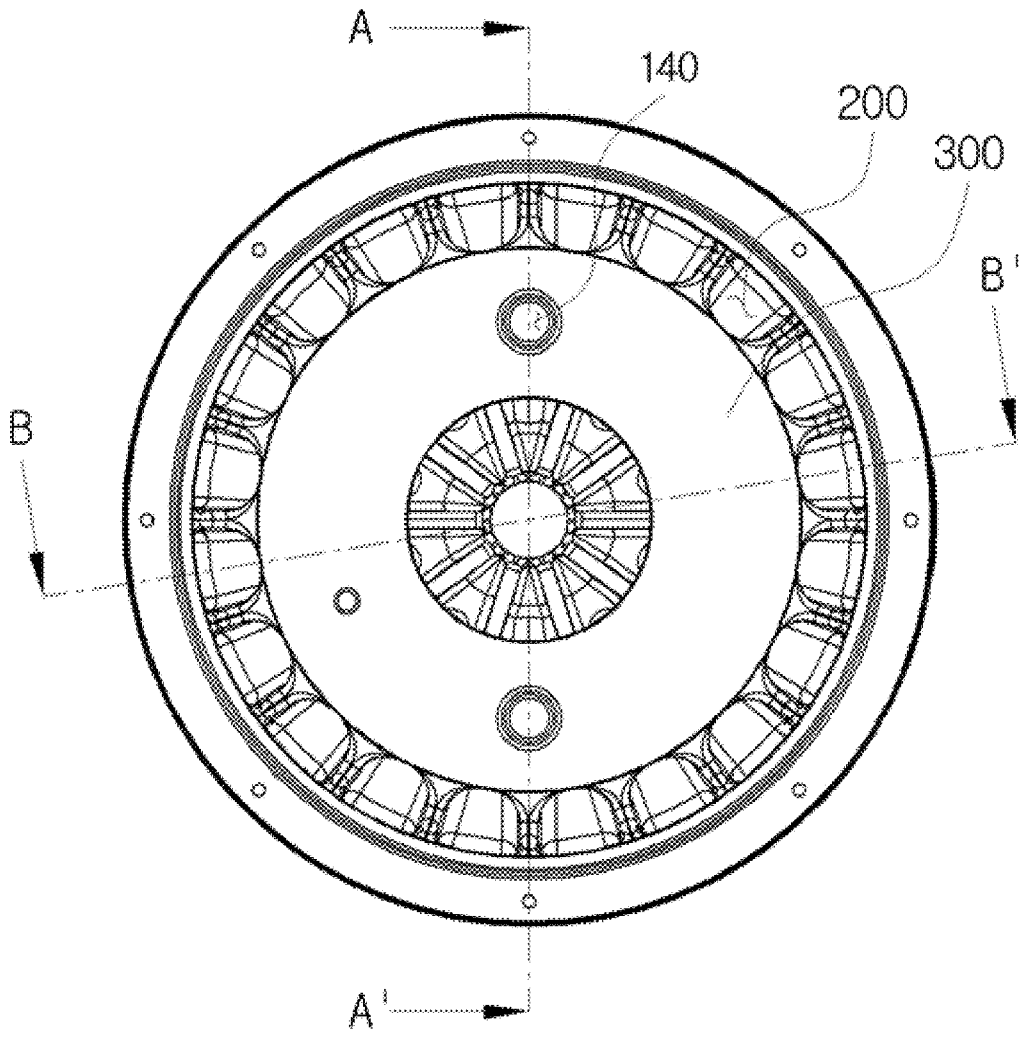
FIG. 4 is a plan view of FIG. 3.
Figure 5:
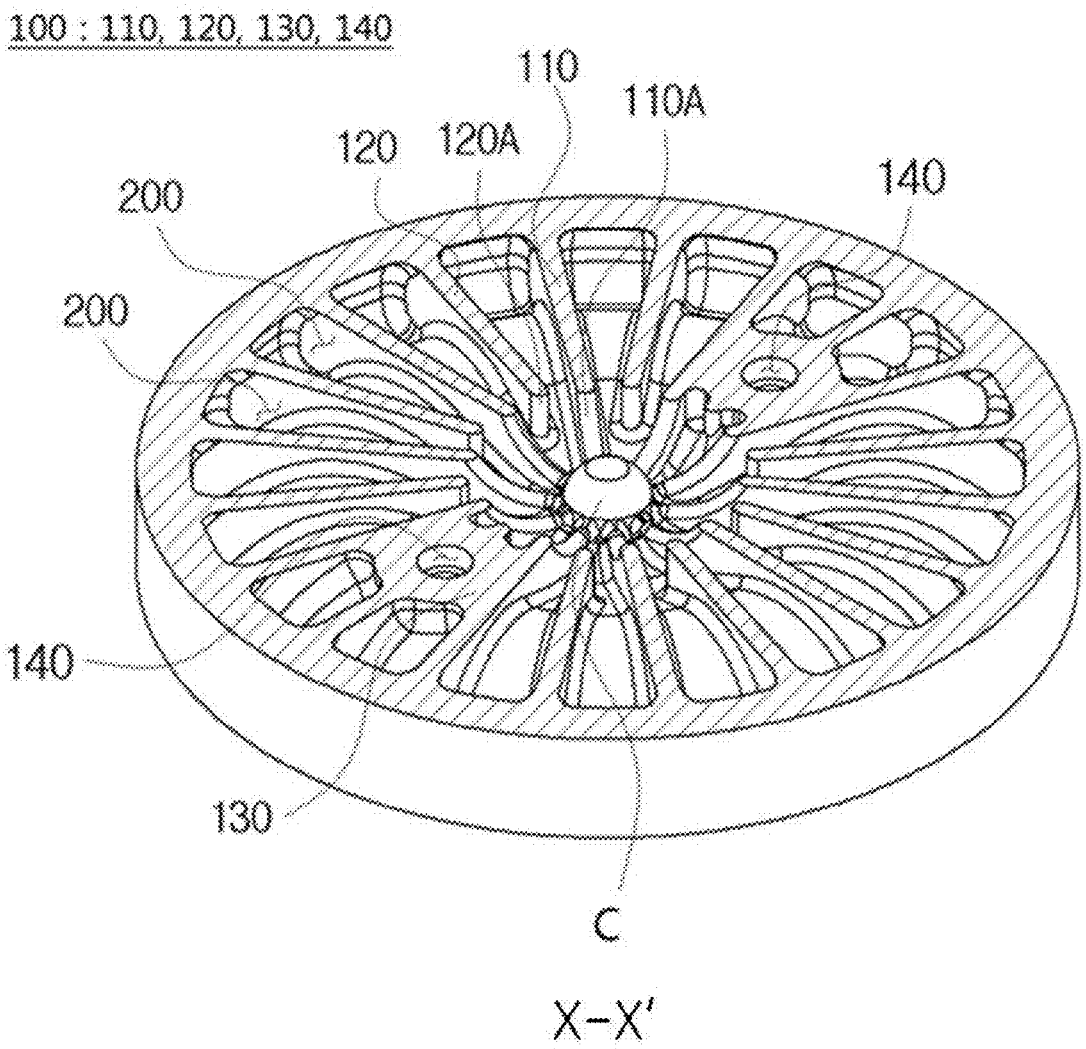
FIG. 5 is a cross-sectional view taken along the line X-X' of FIGS. 8 and 9.
Figure 6:
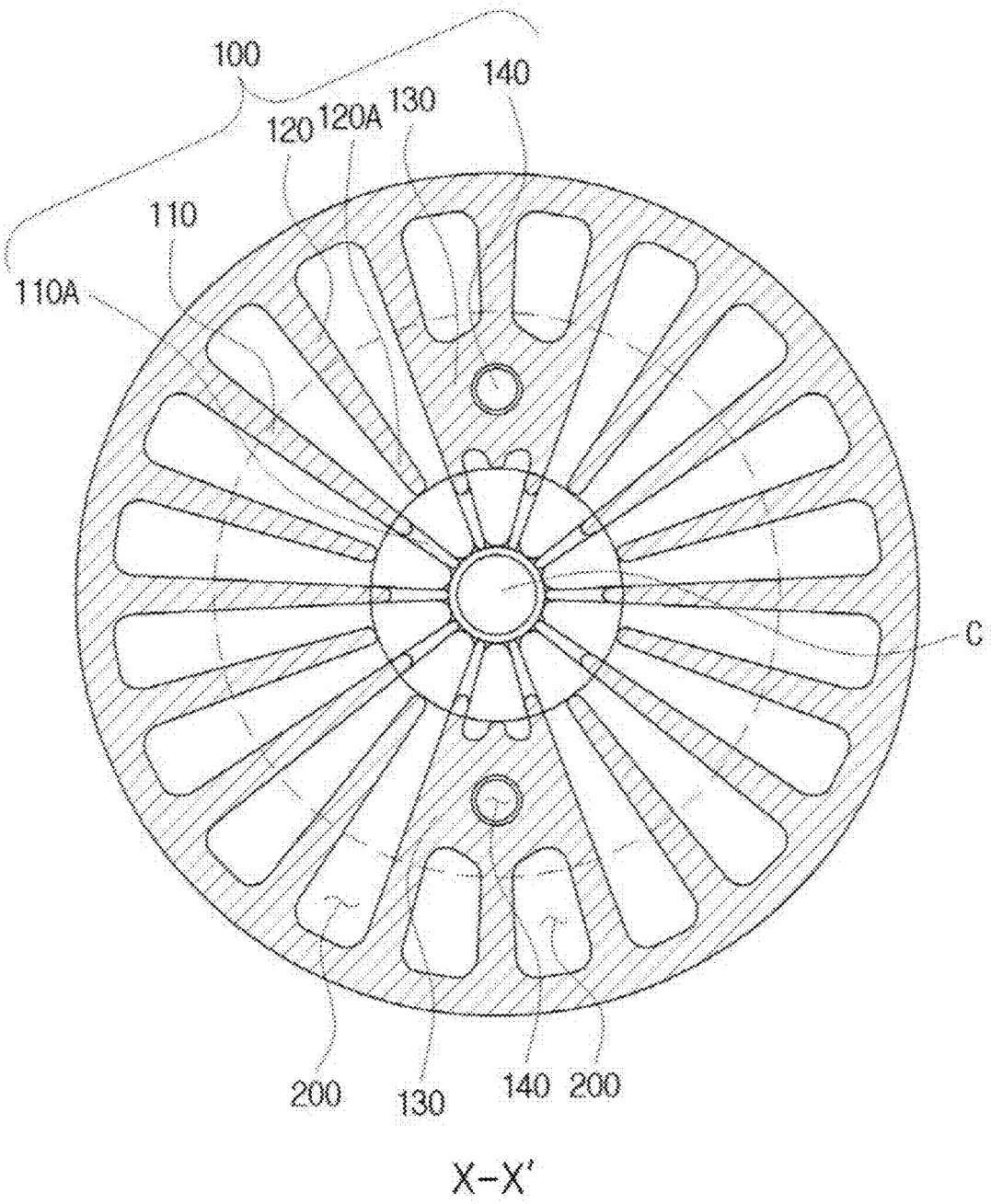
FIG. 6 is a plan view of FIG. 5.
Figure 7:
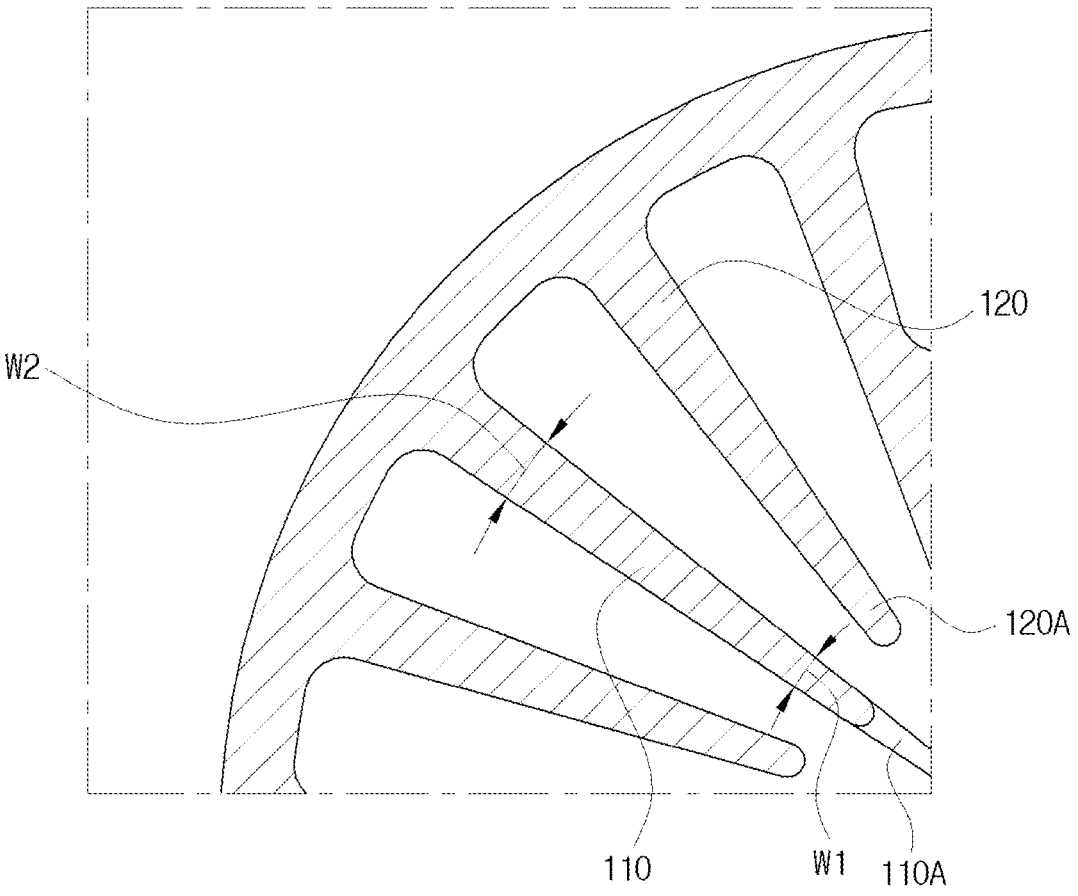
FIG. 7 is a partial enlarged view of FIG. 6.
Figure 8:
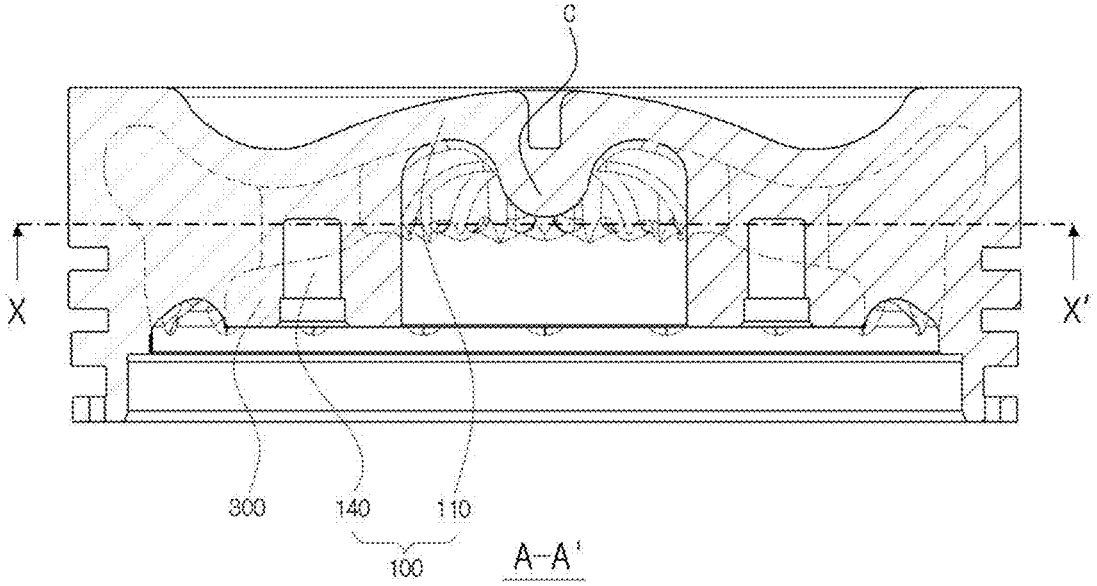
FIG. 8 is a cross-sectional view taken along the line A-A' of FIG. 4.
Figure 9:
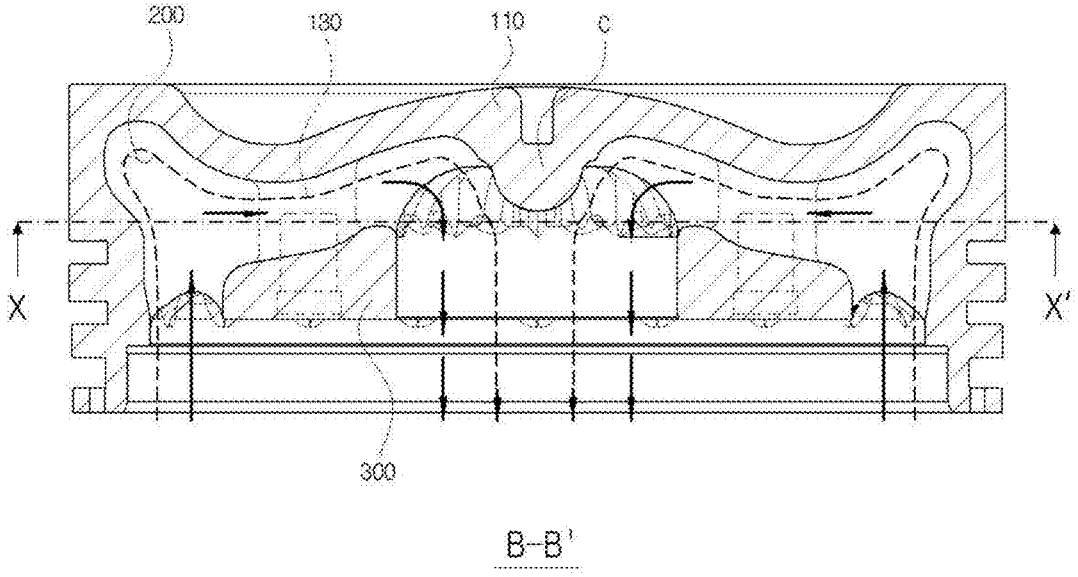
FIG. 9 is a cross-sectional view taken along the line B-B' of FIG. 4.

FIG. 4 is a cross-sectional view taken along a plane vertical to an axial direction of the high pressure piston crown illustrated in FIG. 3, FIG. 6 illustrates an upper plan view of FIG. 5, and FIG. 7 is a partial enlarged view of FIG. 6. FIG. 4 illustrates the high pressure piston crown viewed from the upper portion of FIG. 3, FIG. 8 is a cross-sectional view taken along the line A-A' of FIG. 4, and FIG. 9 is a cross-sectional view taken along the line B-B' of FIG. 4.

As illustrated in FIGS. 4 to 8, the high pressure piston crown includes the rib part 100, an oil gallery 200, and a lower plate 300. The lower plate 300 is disposed under the upper plate 400 and has a smaller diameter than that of the upper plate 400 and a center thereof is perforated with a central hole 310.

As illustrated in FIGS. 5 to 7, the rib part 100 protrudes downwardly from the upper plate to be connected with the lower plate 300 and includes a main rib 110, a sub rib 120, a support part 130, and a bolt hole 140.

As illustrated in FIGS. 5 and 6, a plurality of main ribs 110 are radially disposed and one side of the respective main ribs 110 is connected to a central portion C of the high pressure piston crown. Describing in detail, the plurality of main ribs 100 are radially disposed along an inner circumferential surface of the side wall 500 and extend up to the lower plate 300 downwardly from the upper plate 400 and extend up to the central portion C of the upper plate from the inner circumferential surface of the side wall 500. As illustrated in FIG. 7, a width of the main rib 110 is wider outwardly from the center of the high pressure piston crown, and thus a cross section of the main rib 110 has a trapezoidal shape.

The central portion C convexly protrudes downwardly from the center of the upper plate and changes a flow direction of cooling oil horizontally coming out in a central direction from the oil gallery 200 to a vertical down direction.

The upper plate located at the lower portion of FIG. 3 is connected with the rib part 100 and thus the upper plate is integrated with the rib part 100.

The main rib 110 illustrated in FIGS. 5 and 6 serves to increase structural stability so that the high pressure piston crown may be used at a higher pressure. A height of the main rib 110 may be changed from an inner circumferential surface of the high pressure piston toward a center. As illustrated in FIGS. 8 and 9, the height of the main rib 110 of the inner circumferential surface of the high pressure piston crown is high but may be lowered toward the central portion C. In other words, a thickness of the lower plate 300 may be thicker toward the central portion C. As illustrated in FIG. 5, it can be confirmed that one side 110A of the main rib extends up to the central portion C to be connected to the central portion C.

The height of the main rib 110 may be changed differently in the center of the high pressure piston. The height of the main rib 110 is suddenly lowered from a location where the central hole 310 perforated at the center of the lower plate 300 starts toward the central portion C and thus the main rib 110 may be formed to make cooling oil easily flow in the central hole 310 of the lower plate 300. By this structure of the main rib 110, a flow resistance may be decreased but the strength of the high pressure piston crown may be decreased. However, the main rib 110 and sub rib 120 according to the exemplary embodiment of the present invention is formed in the shape having the width wider outwardly in order to overcome this problem.

As illustrated in FIG. 7, the main rib 110 has a kind of trapezoidal shape in which a width W1 of one side thereof is narrower than a width W2 of the other side thereof. This is to make the cross sectional area of the main rib 110 wider than that of the existing rib having a straight shape to increase the structural stability of the high pressure piston crown, thereby allowing the high pressure piston crown to withstand the higher pressure applied during the explosion stroke of the engine. Even the prior art of the same applicant has a component corresponding to the main rib 110, but does not disclose a trapezoidal shape having the width increasing toward the outside of the piston crown like the main rib 110 illustrated in FIG. 7. Therefore, the larger the size of the cylinder into which the piston is inserted, the lower the structural stability by the rib is. To overcome the problem, the main rib 110 according to the exemplary embodiment of the present invention is formed in the shape having the width wider outwardly.

The main rib 110 may be formed in plural as illustrated in FIGS. 5 and 6, but according to the exemplary embodiment of the present invention, the two main ribs 110 facing each other are formed in pair, preferably, in a plurality of pairs.

As illustrated in FIGS. 5 and 6, the sub rib 120 is disposed between the adjacent main ribs 110 and extends up to the lower plate 300 downwardly from the upper plate 400, extends toward the central portion C from the inner circumferential surface of the side wall 500, and extends up to the central hole 310 of the lower plate 300, and thus the sub rib 120 extends to be shorter than the main rib 110. Further, like the main rib 110, the width of the sub rib 120 is wider toward of the outside of the piston crown 10. The sub rib 120 is also formed to achieve the same object as the main rib 110. In FIGS. 5 and 6, one side 120A of the sub rib does not extend up to the central portion C. The reason is that as the central portion C has a small radius and thus a circumferential length of the central portion C is relatively small, one side 120A of the sub rib may not extend to the outer circumferential surface of the central portion C when the plurality of main ribs 110 extend up to the central portion C. Further, if one side 120A of the sub rib extends up to the central portion C, a flow resistance may be increased when the cooling oil exits between the main rib 110 and the sub rib 120. For this reason, one side 120A of the sub rib does not extend up to the central portion C. Also, for this reason, a distance between one side 120A of the sub rib and one side 110A of the adjacent main rib preferably is larger than the width of one side 120A of the sub rib and one side 110A of the main rib.

The support part 130 connects between the adjacent main ribs 110 or between the sub rib 120 and the main ribs 110 adjacent thereto. Describing in detail, the support part 130 connects between the adjacent main ribs 110 and may extend up to the lower plate 300 downwardly from the upper plate 400. Further, the support part 130 connects between the sub rib 120 and the adjacent main ribs 110 adjacent thereto and may extend up to the lower plate 300 downwardly from the upper plate 400. In FIGS. 5 and 6, the support part 130 connects between the two main ribs 110 and the sub rib 120 formed therebetween. That is, according to the exemplary embodiment of the present invention, the support part 130 connects among a total of three ribs but the present invention is not limited thereto. Therefore, the support part 130 may connect between the adjacent main ribs 110 or between the sub rib 120 and the main ribs 110 adjacent thereto regardless of the number and may connect between only the plurality of main ribs 110 or between only the plurality of sub ribs 120.

The support part 130 connects between the plurality of adjacent main ribs 110 or between the sub ribs 120 or connects between the ribs adjacent to each other, thereby increasing the structural stability. The high pressure piston crown according to the exemplary embodiment of the present invention is applied with the relatively higher pressure. During this process, the high pressure piston crown may be applied with vibration and the vibration direction may be a horizontal direction in addition to a vertical direction in which the high pressure piston crown is applied with a pressure, based on FIGS. 8 and 9. As can be appreciated from FIGS. 8 and 9, the main rib 110 and the sub rib 120 protrude downwardly from the upper plate, and therefore may be vulnerable to, in particular, the horizontal vibration. To overcome this problem, the support part 130 connects between the adjacent main ribs 110 or between the sub ribs 120.

As illustrated in FIGS. 8 and 9, the support part 130 may connect between the adjacent main ribs 110 or the sub ribs 120 and may extend downwardly to be connected with the lower plate 300. The reason why the support part 130 has the above-mentioned structure is also to increase the structural stability. That is, the support part 130 may structurally connect among the main rib 110, the sub rib 120, and the lower plate 300 to serve to withstand the high pressure applied from the engine and reduce the horizontal vibration, in addition to the vertical vibration.

According to the exemplary embodiment of the present invention illustrated in FIGS. 5 and 6, the support part 130 may be formed in two but the present invention is not limited thereto and therefore the support part 130 may be formed in plural. Further, when the radius of the piston is increased, a plurality of support parts 130 may be formed at the main ribs or the sub ribs that are already connected to each other. Describing in detail with reference to an example, one support part 130 connecting between the two main ribs and the sub rib formed therebetween is formed near the inner circumferential surface of the side wall and another support part 130 may be formed near the central portion C, thereby firming the connection therebetween.

The bolt hole 140 illustrated in FIG. 8 is formed on the support part 130 and has a bolt inserted thereinto. That is, the bolt is to couple between the piston skirt and the high pressure piston crown and the piston skirt and the high pressure piston crown may be coupled with each other by the extending support part 130. As described above, the support part 130 may be formed in plural, and therefore when the number of support parts 130 is increased, the bolt coupling between the piston skirt and the high pressure piston crown may also be installed in plural, such that the coupling between the piston skirt and the high pressure piston crown may be firmed.

The oil gallery 200 illustrated in FIGS. 8 and 9 is formed by the rib part 100 and is a space in which the cooling oil introduced from the piston skirt flows. The rib part 100 serves as a kind of guide to make the cooling oil introduced from the piston skirt flow in a specific direction. For the purpose, the rib part 100 has a curved line along the shape of the crown. FIG. illustrates the oil gallery 200 and the direction of the cooling oil introduced and discharged through the oil gallery, in which the cooling oil contacts the piston crown 10 heated by the explosion stroke of the high-temperature engine to serve to cool the piston crown. That is, in FIG. 9, the temperature of the cooling oil introduced from below is relatively lower and the temperature of the cooling oil discharged downwardly is relatively higher.

When viewed from FIGS. 8 and 9, the plurality of main ribs 110 and sub ribs 120 protrude downwardly, and therefore the surface area is increased. The surface area is increased, and therefore the contact area of the cooling oil to the high pressure piston crown is wide to increase the cooling efficiency of the cooling oil. Therefore, when the high pressure piston crown according to the exemplary embodiment of the present invention is used, the high output engine may be used.

The oil gallery 200 and the flow of the cooling oil will be described below in detail. The cooling oil from the piston skirt is introduced through a cooling oil inlet 600 that is formed between the side wall 500 and the outer circumferential surface of the lower plate 300. The cooling oil introduced through the cooling oil inlet 600 flows through a cooling oil channel 700 that is formed among the upper plate 400, the lower plate 300, and the adjacent main ribs 110. The cooling oil flowing through the cooling oil channel 700 is discharged to the piston skirt through the central hole 310 of the lower plate 300. In particular, the high pressure piston crown according to the exemplary embodiment of the present invention is possible to increase the cooling performance of the surface of the piston head by increasing the area contacted with cooling oil in the piston head.

The lower plate 300 is formed in lower part of the high pressure piston crown and the upper portion thereof is coupled with the main rib 110 and the sub rib 120 so that the high pressure piston crown has the oil gallery 200 formed at the upper portion thereof. The central hole 310 formed to be connected to the oil gallery 200 penetrates through the central portion of the lower plate 300 and the space through which the cooling oil lowering the high temperature of the high pressure piston crown is discharged is connected to the piston skirt. As illustrated in FIGS. 8 and 9, the lower plate 300 and the inner side surface of the upper plate are connected to each other by the rib part 100 to serve to transfer the pressure applied from the rib part 100 to the skirt through the assembled surface of the piston crown coupled with the lower portion thereof with the skirt while dispersing the pressure applied from the rib part 100.

The high pressure piston skirt is formed by casting and thus has higher strength than before. Therefore, as the requirement, ductile cast iron having tensile strength of 80 $kgf/mm^2$ and elongation of 5% or more is suitable.

As described above, according to the exemplary embodiments of the present invention, the high pressure piston crown has the sufficient flow channel by which the cooling oil can be contacted with wide area along to the inner surface of the piston head, and the sufficient strength to be able to withstand the high explosion pressure.

Further, as the ribs included in the rib part 100 have a width wider outwardly, the structural stability of the high pressure piston crown may be increased.

Further, according to the exemplary embodiments of the present invention, as the support part 140 may connect between the adjacent main ribs or the sub ribs and extending downwardly to be connected to the lower plate 300, the structural stability of the high pressure piston crown may be increased.

The present invention is not limited to the above-mentioned exemplary embodiments, and may be variously applied, and may be variously modified without departing from the gist of the present invention claimed in the claims.

What is claimed is:

1. A high pressure piston crown coupled with an upper portion of a piston skirt, comprising:

a rib part including a plurality of main ribs that are radially disposed along an inner circumferential surface of the high pressure piston crown, have one side connected to a central portion of the high pressure piston crown;

an oil gallery formed by the rib part and making cooling oil introduced from the piston skirt flow therein; and a lower plate formed under the central portion and connected to the rib part to have an inside thereof connected to the oil gallery, wherein the rib part further includes a plurality of sub ribs that extend toward the central portion, extend to be shorter than the main rib, and have a cross sectional area wider toward an outside of the high pressure piston crown, and characterized in that the rib part further includes:

a support part connecting between the adjacent main ribs or the sub ribs and extending downwardly to be connected to the lower plate; and a bolt hole formed on the support part and having a bolt inserted thereinto.

2. A piston assembly, comprising: a piston skirt coupled to a lower portion of the high pressure piston crown in accordance with claim 1.

3. The high pressure piston crown of claim 1, further comprising:

an upper plate disposed above the lower plate; and a cylindrical side wall extending downwardly from the upper plate, wherein the main ribs are radially disposed along an inner circumferential surface of the side wall, extending up to the lower plate downwardly from the upper plate, and extending up to a central portion of the upper plate from the inner circumferential surface of the side wall.

4. The high pressure piston crown of claim 3, wherein a thickness of the lower plate is thicker toward the central portion and thus a height of the cooling oil channel is lowered toward the central portion.

5. The high pressure piston crown of claim 4, wherein a height of the main rib located at an upper portion of the central hole of the lower plate is lowered toward the central portion.

6. The high pressure piston crown of claim 3, wherein cooling oil from the piston skirt is introduced through a cooling oil inlet that is formed between the side wall and an outer circumferential surface of the lower plate, the cooling oil introduced through the cooling oil inlet flows through a cooling oil channel that is formed among the upper plate, the lower plate, and the adjacent main ribs, and the cooling oil flowing through the cooling oil channel is discharged through the central hole of the lower plate.

* * * * *